US005601461A

United States Patent [19]

Mills

[11] Patent Number: 5,601,461

[45] Date of Patent: Feb. 11, 1997

[54] FLOAT TUBE PROPULSION APPARATUS

[76] Inventor: Steven W. Mills, 13207 Centerburg Rd., Sunbury, Ohio 43074

[21] Appl. No.: 553,956

[22] Filed: Nov. 6, 1995

[51] Int. Cl.[6] ..... B60L 11/02

[52] U.S. Cl. ..... 440/6; 114/345

[58] Field of Search ..... 114/345, 361, 114/354, 343; 441/40, 41, 66, 129; 440/6, 53

[56] References Cited

U.S. PATENT DOCUMENTS

| | | | |
|---|---|---|---|
| 2,150,420 | 3/1939 | Cooper | 114/345 |
| 3,123,840 | 3/1964 | Cefalo, Jr. | 9/2 |
| 3,324,488 | 6/1967 | Schulz, Jr. . | |
| 3,665,534 | 5/1972 | McIntyre | 9/2 |
| 4,329,751 | 5/1982 | Cigognetti | 114/345 |
| 4,596,529 | 6/1986 | Goodman | 440/6 |
| 4,667,618 | 5/1987 | Cigognetti | 114/345 |
| 4,911,094 | 3/1990 | Akers | 114/346 |
| 4,938,722 | 7/1990 | Rizley | 440/6 |
| 5,081,947 | 1/1992 | Holden | 114/345 |
| 5,090,930 | 2/1992 | Walden | 41/131 |

*Primary Examiner*—Edwin L. Swinehart

*Attorney, Agent, or Firm*—Kremblas, Foster, Millard & Pollick

[57] ABSTRACT

A propulsion apparatus for an inflatable float tube. The apparatus comprises a mounting panel with a curved face seating against the curved outer surface of the float tube. A motor is mounted inside a motor housing with a propeller extending from the motor out of the housing. The motor housing is pivotally connected to the mounting panel for fastening. A pair of secondary mounting panels, each having curved faces, can be attached to the mounting panel and attached to parallel, facing, curved surfaces of a parallel pontoon float tube.

15 Claims, 9 Drawing Sheets

FLOAT TUBE PROPULSION APPARATUS

TECHNICAL FIELD

The invention relates generally to an accessory for attachment to an inflatable float tube, and more specifically relates to a propulsion apparatus for removable attachment to a float tube.

BACKGROUND ART

Float tube is a generic name for a class of inflatable rafts used by anglers. Float tubes are small, lightweight vessels which are typically used by a single person to quietly fish in a body of water without submerging the angler's entire body into the water, but still submerging a portion for stability and maneuvering.

Because the operator's center of mass is lower in a float tube than in a conventional raft or boat, the float tube can be constructed from a simple automobile innertube. The operator inserts his or her legs through the hole in the innertube and submerges his or her legs and torso into the water until the underarms rest against the edges of the innertube. A small hammock-like structure can be suspended between two sides of the innertube to form a cradle for more comfortably supporting the weight of the operator's body while leaving the operator's arm free.

FIG. 1 shows a conventional, prior art float tube 10 which is circular, similar to an automobile innertube. Float tubes include any small, inflatable or otherwise lightweight, one or two-person rafts. Float tubes are commonly referred to as kick boats, pontoon boats and float boats. The float tube 10 normally has an outer sleeve-like, fabric skin 12 which fits tightly against the innertube. Typically, the skin 12 is fixedly attached to the innertube providing a surface for attachment of a seat rest 14.

FIGS. 2 and 3 show additional prior art float tubes having U-shaped and parallel pontoon configurations, respectively. The U-shaped float tube 16 shown in FIG. 2 has an inflatable bladder (not visible in FIG. 2) which is enclosed by a skin 18. The skin 18 is similar to the skin 12 of FIG. 1 and encloses the bladder of the tube 16 providing an attachment surface for a seat 20. The float tube 22 shown in FIG. 3 is made of two elongated inflatable bladders enclosed by sheet-like skins 24 and 26. The skins 24 and 26 are similar to skin 12 of FIG. 1, and provide attachment surface for support bracket 28 and seat rest 30.

Most float tubes use human power to propel the float tube along the water surface. This typically involves fins fitted to the operator's feet which are kicked in the manner of a scuba diver or a pair of oars connected to propel and guide the float tube. Conventional trolling motors are also attached to float tubes to provide propulsion.

Walden, in U.S. Pat. No. 5,090,930, shows an apparatus which wraps around the circumferential outer surface of a float tube to attach a boat motor to the rear of a float tube. The Walden apparatus includes a buoyant device to support the motor and battery due to their size and weight.

Schulz, in U.S. Pat. No. 3,324,488, shows a similar, motor attachment for rigidly affixing a motor to a foam, annular tube by rods fixed to or extending into the foam.

Cefalo, in U.S. Pat. No. 3,123,840, shows a float tube connection for attaching boat oars and a conventional boat motor to a float tube. This apparatus is large and heavy, and requires a buoyant flotation device for the motor.

Goodman, in U.S. Pat. No. 4,596,529, discloses members permanently attached to a flexible boat. A boat motor is attached to the permanent members which are flexed apart in order to insert a motor housing shaft between the members.

In U.S. Pat. No. 4,938,722, Rizley shows a motorized attachment for the fisherman's leg which propels the fisherman and float tube. A separate innertube is attached to the float tube and supports the battery supplying power to the electric motor.

U.S. Pat. No. 4,911,094 to Akers shows a very similar apparatus to that of Rizley but with the motor attached to the secondary innertube instead of the user's leg.

In Holden, U.S. Pat. No. 5,081,947, two interlocking, concave bodies fit together within the aperture of an innertube. The bodies lock together and form a seat for the fisherman, and provide pedals and a propeller for propelling the innertube.

McIntyre, in U.S. Pat. No. 3,665,534, shows a motor support framework which attaches to a fishing float. The framework supports a conventional motor attached to its rear and operated in the conventional manner by the hands of the user rotating the motor about a pivot. The framework attaches to the float tube by a pair of parallel straps encircling an edge of the tube.

All of the above described propulsion devices suffer from the defect of either too little propulsion power or too much weight and bulk. The desirable characteristics of a float tube are small size and light weight, permitting the fisherman to carry the float tube to remote locations for use where a conventional raft or row boat would be difficult to transport or possibly too large to use. Furthermore, quiet operation with sufficient power to propel a fisherman against any water currents or wind forces which may be present are highly desirable.

Since most conventional propulsion devices either have too little power to sufficiently propel a float tube user, or have too much weight to maintain one of the primary advantages of using a float tube, the need exists for a propulsion apparatus for mounting to a float tube to provide sufficient power while maintaining the weight, size and lower cost advantages of the float tube compared to conventional fishing boats.

BRIEF DISCLOSURE OF INVENTION

A propulsion apparatus is disclosed for attachment to a float tube. The float tube has an outer, sheet-like skin extending around and conforming to a cylindrical portion of the float tube which forms a curved outer surface. The propulsion apparatus comprises a mounting panel having a concave face which is conformed to seat against the curved, outer surface of the float tube. A motor housing is pivotally connected to the mounting panel, and houses a motor to which a propeller is attached. The apparatus further comprises a fastener, at least a portion of which is conformed to attach to the outer skin of the float tube, for removably fastening the mounting panel to the outer skin. An energy source provides energy to the motor.

The invention further contemplates two mounting panels, each panel having a concave face conformed to seat against the curved outer surface of the float tube. Furthermore, each mounting panel has a fastener conformed to attach to the outer skin for removably fastening each mounting panel to the outer skin.

Figure 1:
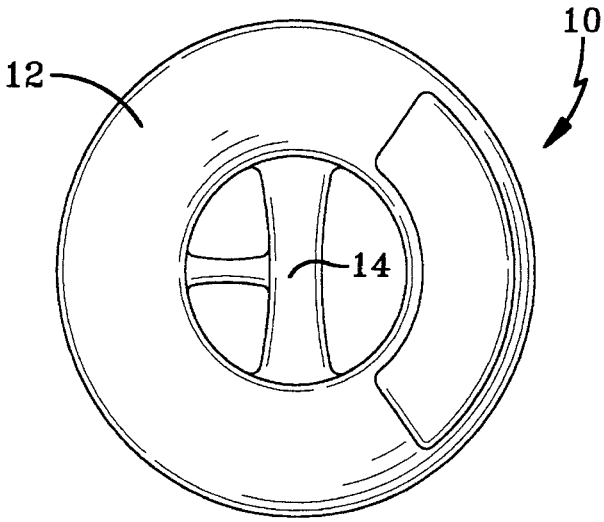
FIG-1 PRIOR ART
FIG. 1 is a top view illustrating a prior art float tube.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art. In addition, a circuit is illustrated which is of a type which performs well known operations on electronic signals. Those skilled in the art will recognize that there are many, and in the future may be additional, alternative circuits which are recognized as equivalent because they provide the same operations on the signals.

DETAILED DESCRIPTION

Figure 4:
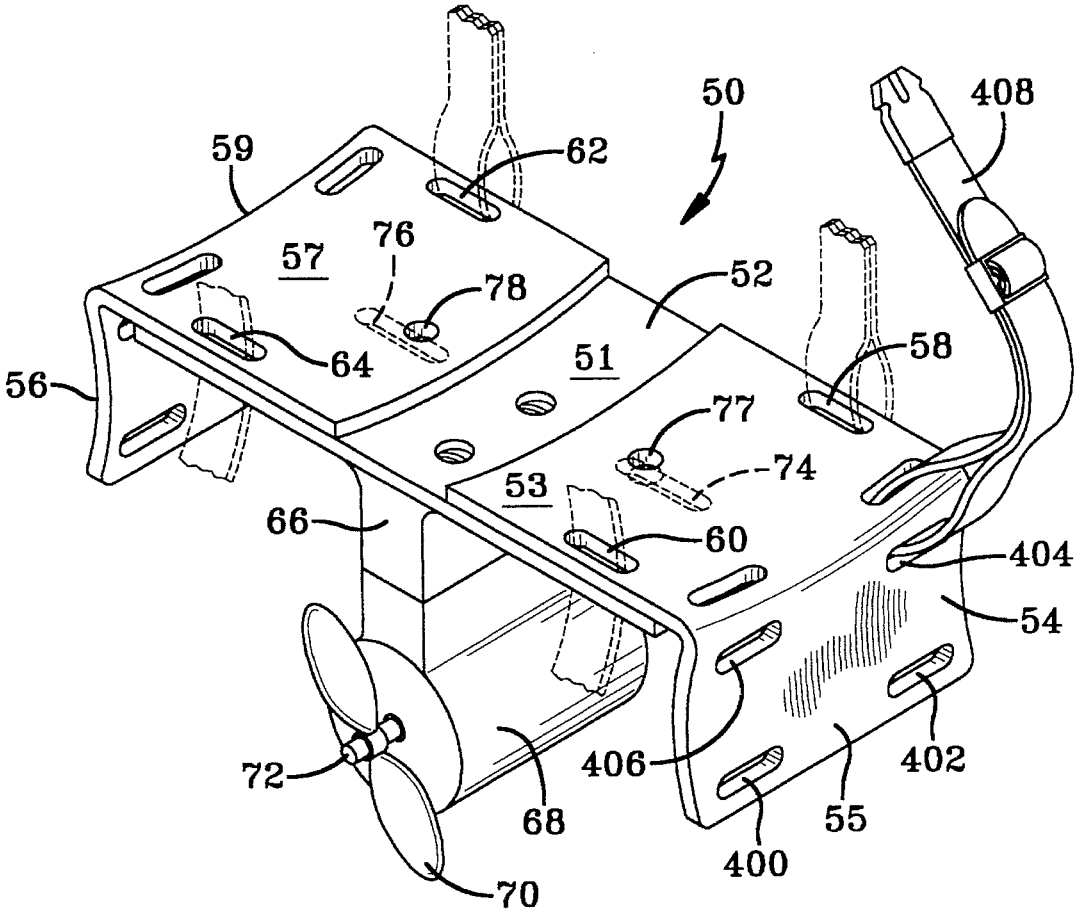
FIG. 4 is a view in perspective illustrating a preferred embodiment of the present invention.

FIG. 4 shows the preferred propulsion apparatus 50 for use with prior art float tubes. One advantage of the propulsion apparatus 50 is its light weight, which is less than 6 pounds (including a battery). Additionally, the propulsion apparatus 50 is adapted to attach to and propel virtually any of the popular float tubes. Most prior art devices which have as an objective the propulsion of a float tube add a substantial amount of weight to it by using conventionally existing motors. Alternatively, the prior art teaches to merely attach an existing motor to the float tube by a mounting means which accommodates the motor's existing mounting configuration. By designing a new, universally attachable propulsion apparatus, the Applicant has arrived at a more lightweight device which is better adapted to use with a conventional float tube than any other device. Most trolling motors alone weigh at least 16 or 17 pounds, and they must be somehow attached to a float tube; usually with heavy, complex mounts. The Applicant knows of no commercially available device similar to the propulsion apparatus 50 which is lightweight, universally mountable, and very compact.

The propulsion apparatus 50 is made up of a primary central mounting panel 52 having a curved, concave face 51. Angled, secondary mounting panels 54 and 56 are rigidly mounted to the central panel 52, and each secondary panel 54 and 56 has a pair of curved, concave faces 53, 55, 57 and 59, respectively. Extending downwardly from rigid attachment to the central panel 52 is a motor housing column 66. Pivotably attached to column 66 is motor housing 68 which houses an electric motor (not visible in FIG. 4). A propeller 70 is connected to the shaft 72 of the motor. The motor and attached rotating propeller 70 propel the propulsion apparatus 50, and consequently an attached float tube, through the water.

Since the central panel 52 and the secondary panels 54 and 56 have surfaces 51, 53, 55, 57 and 59 of similar curvature to the convex exterior surface of most float tubes, any of these panels can firmly seat against and attach to the curved outer surfaces of most float tubes. The apparatus shown in FIG. 4 can be attached to any conventional float tube in many different ways.

When the propulsion apparatus of the present invention is attached to a float tube, the propeller may be directed either toward the front or the back. Since the apparatus can also be attached to either the front or the back (or somewhere along the length) of the float tube, the direction in which it is pointed is determined by the proximity of the fisherman to the motor and the existence of a preferred protective cover over the propeller. This cover, referred to below, keeps the fisherman's clothing and fishing equipment from contact with the propeller. It is normally preferred to direct the propeller away from the fisherman.

Figure 2:
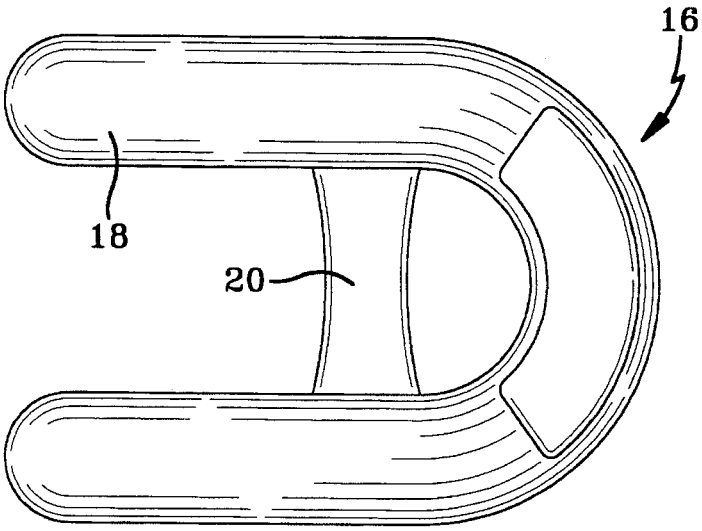
FIG-2 PRIOR ART
FIG. 2 is a top view illustrating a prior art float tube.
Figure 3:
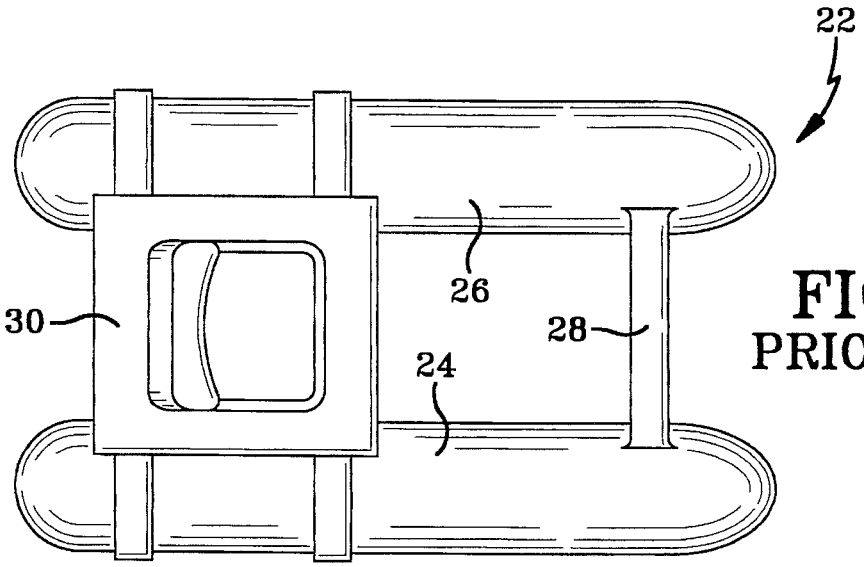
FIG-3 PRIOR ART
FIG. 3 is a top view illustrating a prior art float tube.
Figure 6:
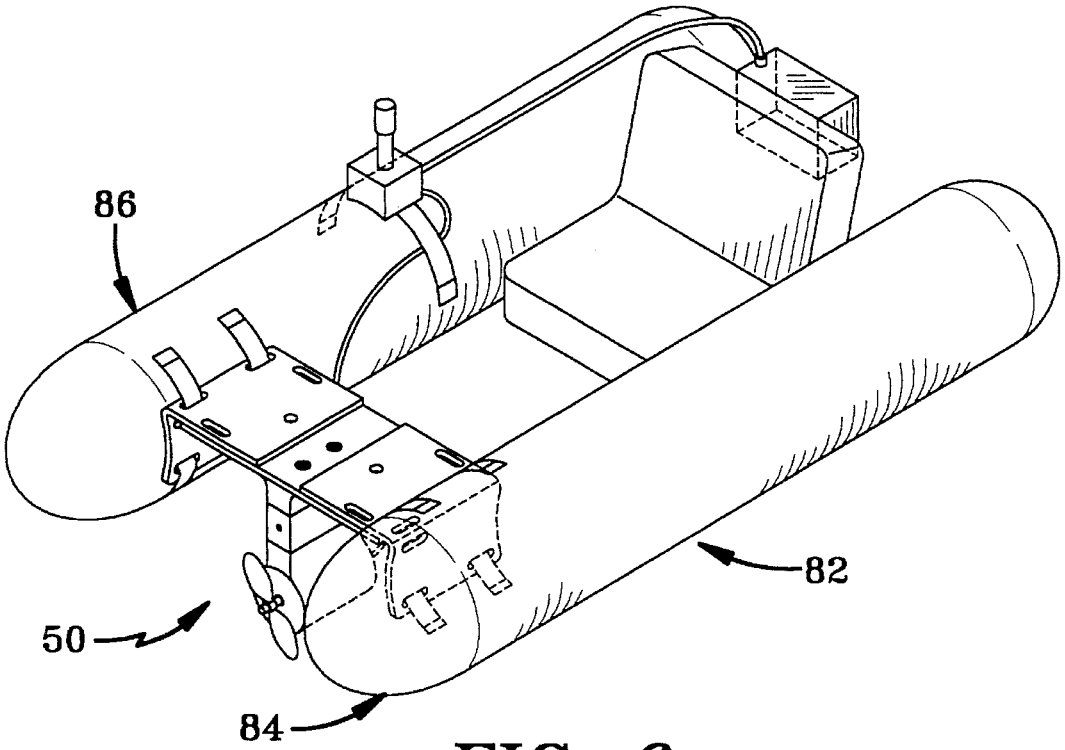
FIG. 6 is a view in perspective illustrating the preferred embodiment in an alternative operable position.

FIG. 6 shows the propulsion apparatus 50 attached to a conventional float tube 82 in one of the many possible ways. Float tube 82 has spaced pontoons 84 and 86. These spaced pontoons 84 and 86 exist in this parallel, spaced arrangement on both the U-shaped float tube 16 shown in FIG. 2 and the parallel pontoon float tube 22 shown in FIG. 3. With either of these conventional float tubes, the substantially oppositely facing surfaces 55 and 59 of secondary panels 54 and 56 can be seated against the curved, outer, facing surfaces of the pontoons 84 and 86. When surfaces 55 and 59 are seated against the curved outer surfaces of the pontoons 84 and 86, the central panel 52 is attached to the undersides of secondary panels 54 and 56. Mounted in this way, propulsion apparatus 50 spans the gap between the parallel pontoons 84 and 86. Motor housing 68, and possibly more of the apparatus 50, is submerged beneath the surface of the water.

Figure 5:
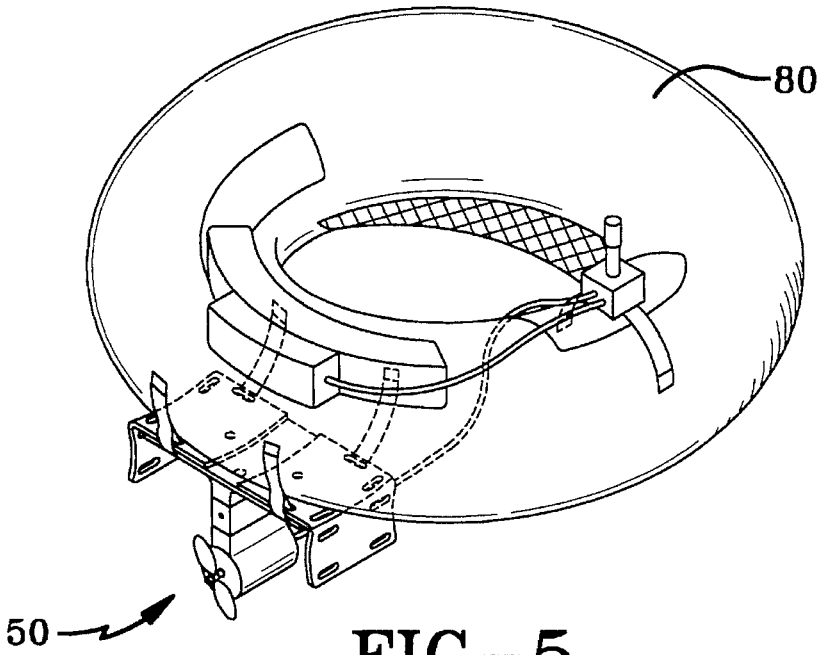
FIG. 5 is a view in perspective illustrating the preferred apparatus in an operable position.

FIG. 5 shows another way of attaching apparatus 50 to a float tube, shown here attached to the rear. The surface 51 of central panel 52 can be the only surface seated against and attached to a surface of float tube 80, shown in FIG. 5 as the underside of tube 80, submerging the entire propulsion apparatus 50 beneath the water surface. When this manner of attachment is used, the secondary panels 54 and 56 can be removed.

Since secondary panels 54 and 56 extend away from the float tube and may act like laterally curved rudders, it may be desirable to remove them to limit any unwanted interference with operation of the float tube. However, if lateral or rotational stability is desired, the secondary panels 54 and 56 can be left in place to serve as a keel to prevent motion of the float tube. These curved panels 54 and 56 extend downwardly into the water beneath the float tube when attached as shown in FIG. 5 and provide stability to prevent lateral motion of the float tube caused by wind or currents. These panels also prevent rotational motion of the float tube due to the motion of a fisherman casting a fishing rod. Secondary panels 54 and 56 provide the feature of universal attachment to virtually any float tube, and also stabilize the float tube from undesired lateral or rotational motion.

Figure 12:
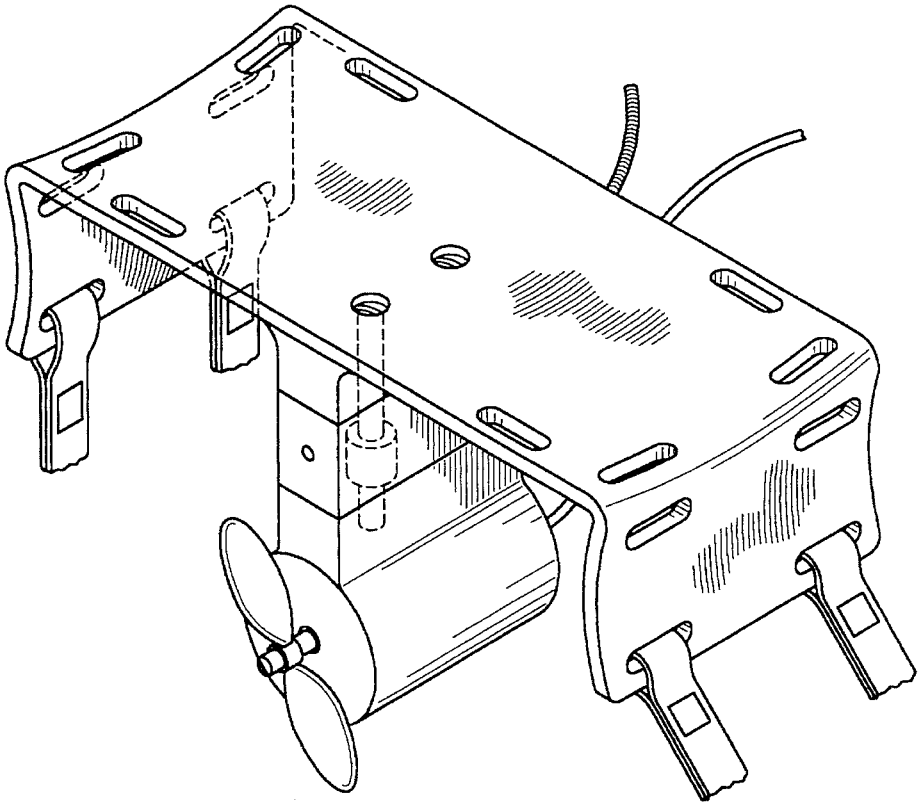
FIG. 12 is a view in perspective illustrating an alternative embodiment.

The secondary panels 54 and 56 may be made integral with the central panel 52, and therefore not removable from the central panel 52 (as shown in FIG. 12). For most purposes this is suitable, but the lateral adjustability (and also the removability) existing in the preferred embodiment is lost. The lateral adjustability arises from the means by which the secondary panels 54 and 56 are attached to the central panel 52. A pair of slots 74 and 76 (shown in hidden lines in FIG. 4) align with a pair of apertures 77 and 78 formed through the secondary panels 54 and 56, respectively. Bolts (not shown) extend through the holes 77 and 78 and the slots 74 and 76 and thread into nuts on the underside of the central panel 52 to clampingly attach the secondary panels 54 and 56 to the central panel 52. The slots 74 and 76 are longer than the holes 77 and 78, and therefore the panels 54 and 56 can be adjusted laterally inwardly and outwardly and still fasten to the central member 52 by clamping the bolts through the holes 77 and 78 and slots 74 and 76. This lateral adjustability allows the propulsion apparatus 50 to be attached to parallel pontoon and U-shaped float tubes of varying spacing between the facing, outer surfaces of the pontoons to which the apparatus is attached. Furthermore, the fastening mechanism permits the secondary panels 54 and 56 to be removed when they interfere with operation of the apparatus.

Slots 58, 60, 62 and 64 are formed in the secondary panels 54 and 56 and also extend through central panel 52. When the apparatus 50 is attached to a parallel pontoon float tube as shown in FIG. 6, it is preferred that bolts extend through slots 58, 60, 62 and 64, to enhance the rigid attachment of the secondary panels 54 and 56 to the central panel 52. Secondary panel 54 is then attached to a pontoon by attaching a belt to one of either slot pair 400 and 406 or pair 402 and 404. This belt then extends around the pontoon and attaches either to the pontoon outer skin or extends completely around the pontoon outer skin and attaches to the second slot of the slot pair. For example, belt 408 is shown in FIG. 4, and could extend from slot 404 completely around a pontoon and attach into slot 402. A second belt would extend from slot 406 completely around a pontoon and attach to slot 400. A similar set of slot pairs is formed in secondary panel 56 and secondary panel 56 attaches to the opposing, parallel pontoon in a similar manner.

When the apparatus 50 is attached to only one surface of a float tube, as shown in FIG. 5, the bolts extending through slots 58, 60, 62 and 64 are removed and two or more belts extend through two or more of these four slots. The belts attaching the apparatus 50 to a float tube also serve to hold secondary panels 54 and 56 attached to central panel 52, since they extend through slots formed in both secondary panels 54 and 56 and central panel 52.

Since the distance between surfaces 55 and 59 is adjustable, the propulsion apparatus can be made to fit virtually any float tube. With the secondary panels 54 and 56 attached to primary panel 52, the propulsion apparatus can be attached either to the side or underside at the front or the rear of a float tube (with only panel 52 attached) or to two facing surfaces of a float tube (with both secondary panels 54 and 56 attached to the facing, outer float tube surfaces).

Figure 17:
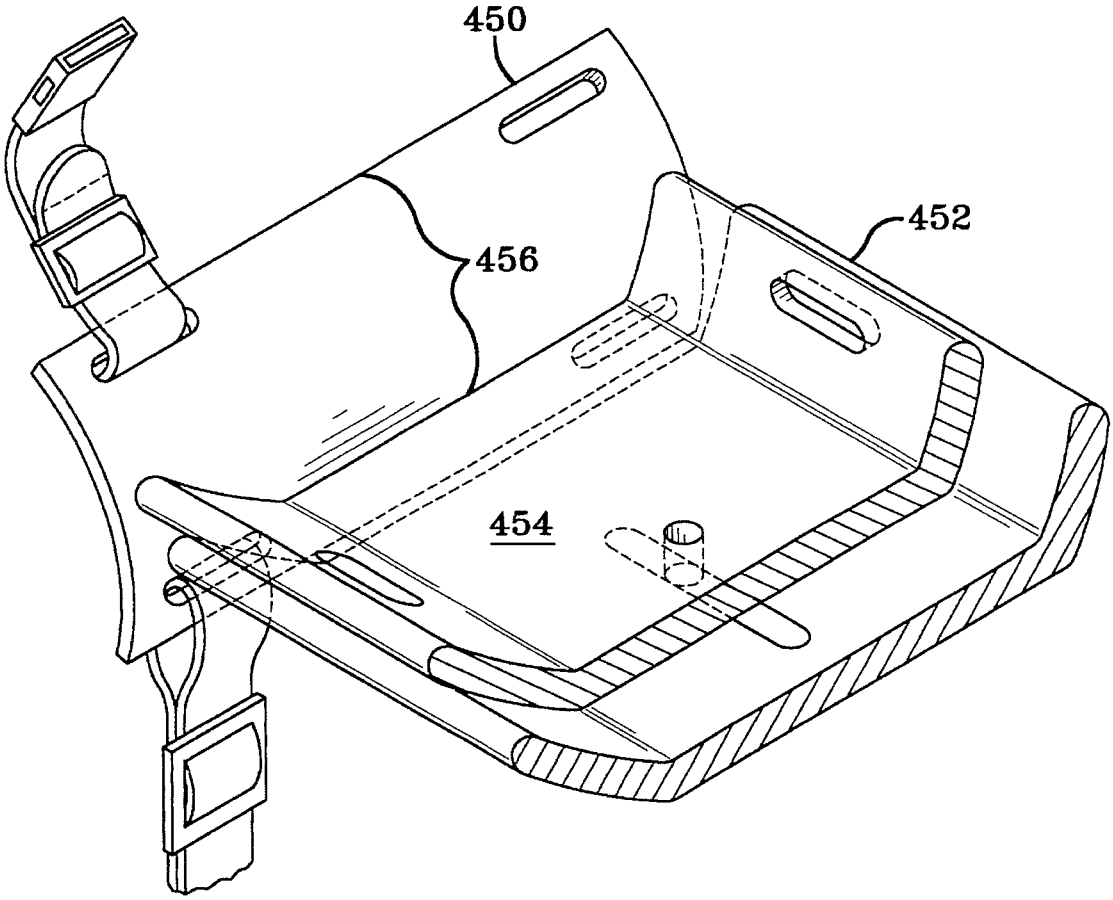
FIG. 17 is a view in perspective illustrating an alternative, secondary mounting panel.

An alternative, adjustable secondary panel 450 is shown in FIG. 17 as slidingly attached to central panel 52. Secondary panel 450 is not preferred to secondary panels 54 and 56 of FIG. 4, since secondary panel 450 has a portion 456 above concave surface 454, restricting its universal attachment. If central panel 452 is to be mounted to a single curved outer surface similar to that shown in FIGS. 5, 7 and 13, the upper portion 456 would interfere with this attachment. The secondary panel 450 would then have to be removed, rather than leaving removal of secondary panels as an option as with the preferred secondary panels 54 and 56. However, secondary panel 450 offers an advantageous shape for attaching to a pair of parallel pontoons similar to that shown in FIG. 6. This is because the upper portion 456, which interferes in some mounting arrangements, provides additional mounting support in others. Secondary panel 450 attaches to central panel 452 similarly to secondary panels 54 and 56 of FIG. 4.

It is possible to attach a single propulsion apparatus to only one of two parallel pontoons of a pontoon-type float tube if the direction of thrust is angled to propel the float tube forwardly. It is also possible to use two or more of the propulsion devices either on opposite sides of a float tube (in parallel) or along an axis extending from the front to the rear of the float tube (in series). However attachment to the underside at the front or rear of a round or U-shaped float tube, or to the outer facing surfaces at a point along the length of a U-shaped or parallel pontoon float tube is preferred for simplicity and minimal weight.

Figure 7:
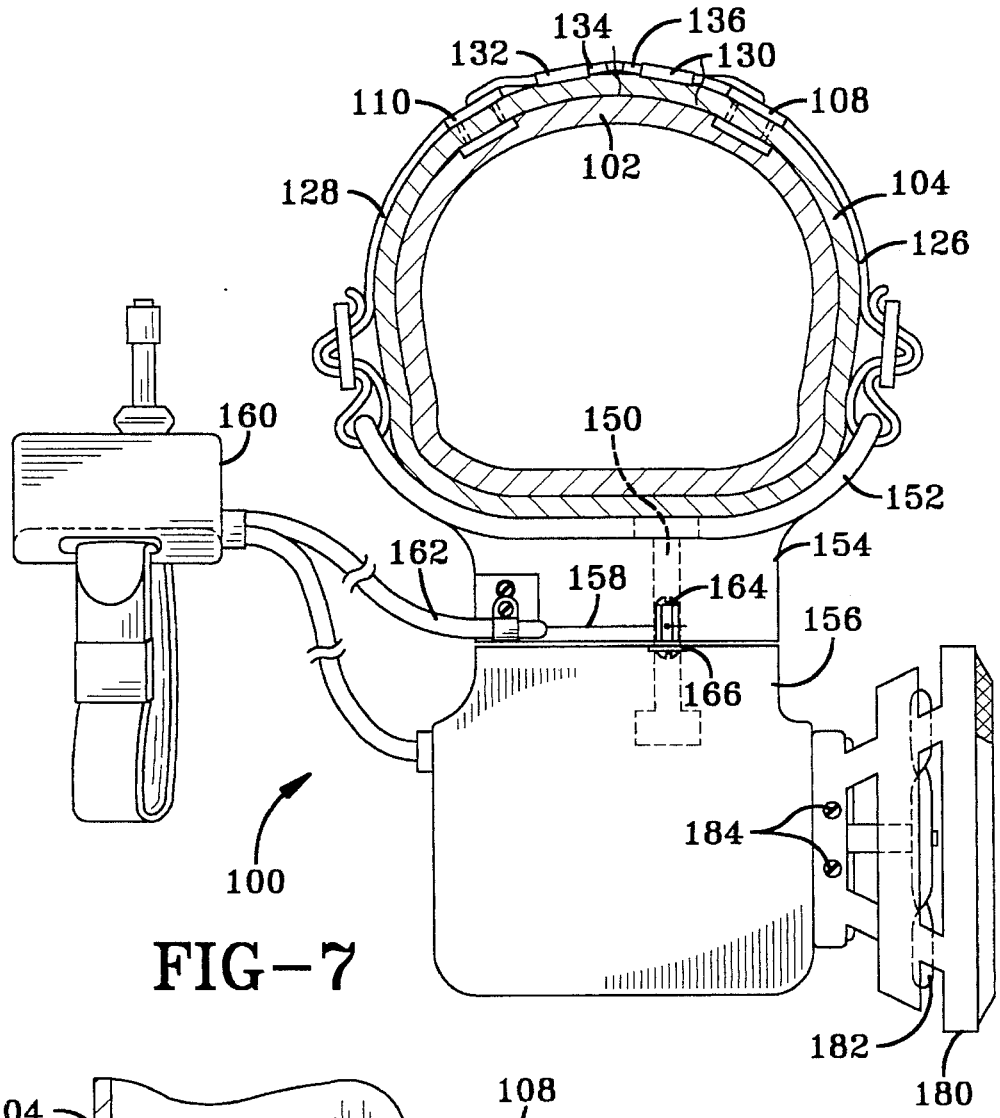
FIG. 7 is a side view in section illustrating the propulsion apparatus.

Propulsion apparatus 100, shown in FIG. 7, has fasteners which attach to the float tube permitting easy removal and attachment. Float tube bladder 102 is an air-tight inflatable bladder which provides buoyancy necessary to a float tube. Outer skin 104 covers the bladder 102 to protect it and also provide a site for attachment to the float tube. Outer skin 104 is typically made of a strong nylon or mesh fabric which is sewn or zipped together at a seam 106 which connects two adjoining edges of the skin 104. In the preferred embodiment, the seam 106 is a conventional zipper (interlocking teeth) fastener which permits removal of the skin for cleaning, repair, etc.

Figure 8:
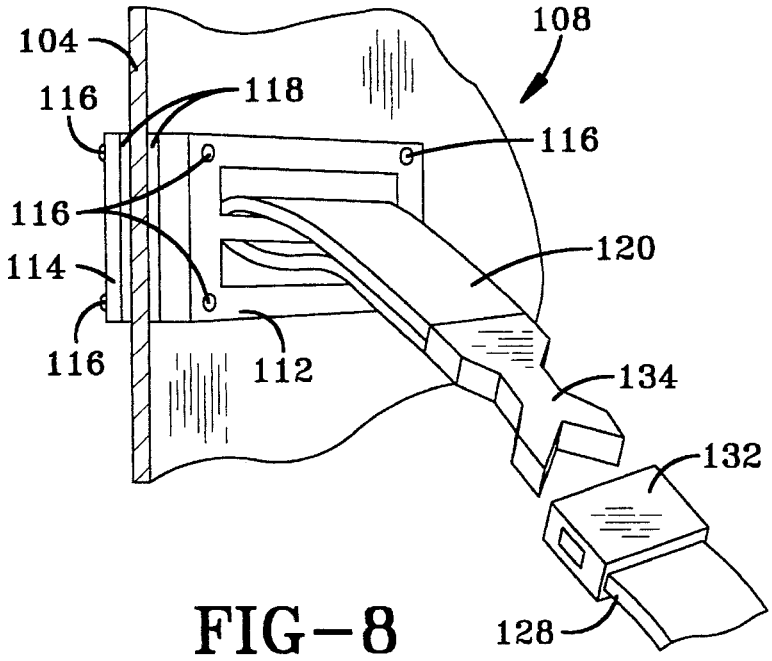
FIG. 8 is a section view in perspective illustrating a detailed fastener.

The propulsion apparatus 100 is attached to the outer skin 104 of the float tube by fasteners 108 and 110, which prevent rotation of the mounted apparatus relative to the skin 104, and skin 104 is generally tight and held in place by friction, keeping it unmoving relative to the float tube. Fastener 108 is shown in FIG. 8 in greater detail. Fastener 108 attaches to the outer skin 104 by clamping the skin 104 between a bracket member 112 and a backing member 114. Screws 116 extend through bracket member 112, gasket 118, outer skin 104 and the backing member 114 to clampingly engage both the bracket member and the backing member, clamping the outer skin 104 therebetween. Sheet-like gaskets 118 are placed between the outer skin 104 and both the bracket member 112 and backing member 114. The gaskets 118 are flexible, preferably elastomeric, rubber-like sheets which compress under the clamping force of the fastener 108 to provide a cushion between the sharp edges of members 112 and 114, and the flexible, potentially tearable outer skin 104. Gaskets 118 also distribute the compressive force of screws 116 to further prevent tearing at the screws 116 and act as a lock-washer to prevent screws 116 from slowly loosening over time.

A belt 120 wraps through the bracket member 112 and attaches to a male fastener member 134. The male fastener member 134 is inserted into and interlocks with female fastener member 132 which is attached to a belt 128 extending from the propulsion apparatus 100.

Referring again to FIG. 7, fasteners 108 and 110 clampingly engage the outer skin 104 on opposite sides of the seam 106. Belts 126 and 128 are attached to, and extend in a direction away from, the propulsion apparatus 100. Female fastener members 130 and 132 are attached to the ends of belts 126 and 128, respectively. Male fastener members 134 and 136 extend from fasteners 108 and 110, respectively. Belts 126 and 128 extend away from the propulsion apparatus 100 over and past seam 106 and male fastener members 134 and 136 attach to female fastener members 130 and 132 of the fasteners 110 and 108, respectively. With the positioning of the fasteners 108 and 110 on opposite sides of the seam, tension on the attaching belt pulls the edges of skin 104 toward seam 106, thereby limiting the possibility of the seam separating under stress on the propulsion apparatus 100.

The preferred fasteners 108 and 110 shown in FIG. 7 are not, of course, the only possible means for fastening the propulsion apparatus to a float tube. For example, it is possible to merely use a pair of belts or a single belt extending around the float tube sidewall. Additionally, there are many conventional fasteners which would be suitable for fastening the mounting panels to a curved outer surface of the float tube. Mating hooks and loops surfaces (similar to that sold under the trademark VELCRO), snaps, zippers, and sewing of the mounting panel to the float tube outer skin could all be used to attach the propulsion apparatus to the float tube. Numerous other means for fastening the propulsion apparatus to a float tube will be obvious to one of ordinary skill in the art.

Curved mounting panel 152, shown in FIG. 7, extends partially around the circumferential surface of the float tube sidewall to which it is attached. The mounting panel 152 could, of course, extend around less of the float tube sidewall or around substantially more of the sidewall than is shown in FIG. 7. The amount the panel 152 extends around the tube sidewall is determined by the amount necessary for the fastening apparatus used and the degree of universal fit desired. The panel 152 could not, for example, extend around substantially more than half of the circumference of the float tube sidewall if it is to be attached when the float tube is fully inflated. If the propulsion apparatus is to be attached to the float tube prior to full inflation, the mounting panel 152 could surround substantially all of the float tube sidewall once it is inflated. For example, the mounting panel 152 could be shaped to surround all but a small part of the exterior surface of the float tube, leaving a small slot in which a deflated float tube is inserted. Once the deflated float tube is inserted through this slot, the float tube can be inflated, thereby expanding against the interior walls of the mounting panel. Because a frictional engagement would be created between the interior surface of this mounting panel and the curved outer surface of the inflated float tube by this structure, it would serve as the fastener to fasten the mounting panel to the float tube. The frictional engagement is therefore all that is necessary to fasten the propulsion apparatus to a float tube.

Once the propulsion apparatus of the present invention is attached to a float tube, the propelled float tube must be steered by some mechanism. The motor housing could be rigidly mounted to panel 152 and a conventional rudder could be used. However, it is preferred that shaft 150 (shown in hidden lines in FIG. 7) extends downwardly from the mounting panel 152 through the motor housing column 154 and into the motor housing 156. The shaft 150 permits pivotal rotation of the motor housing 156 about the shaft 150 and therefore relative to the mounting panel 152. Sheathed cable 158 extends from an actuator 160 through a sheath 162 (which is rigidly fastened to the motor housing column 154) and attaches to the motor housing 156. A screw 164 preferably seats against the cable 158 by threading into a platform 166 which is rigidly attached to (and extends laterally out from) the motor housing 156. Upon actuation of the actuator 160, the cable 158 is withdrawn or extended, moving the platform 166 relative to the column 154, thereby causing the motor housing 156 to pivot about the shaft 150. The pivoting directs the thrust of the motor in the desired direction, steering the attached float tube.

An adaptor could be added between housing column 154 and motor housing 156 to increase the distance between the mounting panel 152 and the motor during operation. Additionally, an adaptor could change the angle of the motor relative to the mounting panel. By changing this angle, the mounting panel could be attached to a side of the float tube, rather than the underside.

Figure 13:
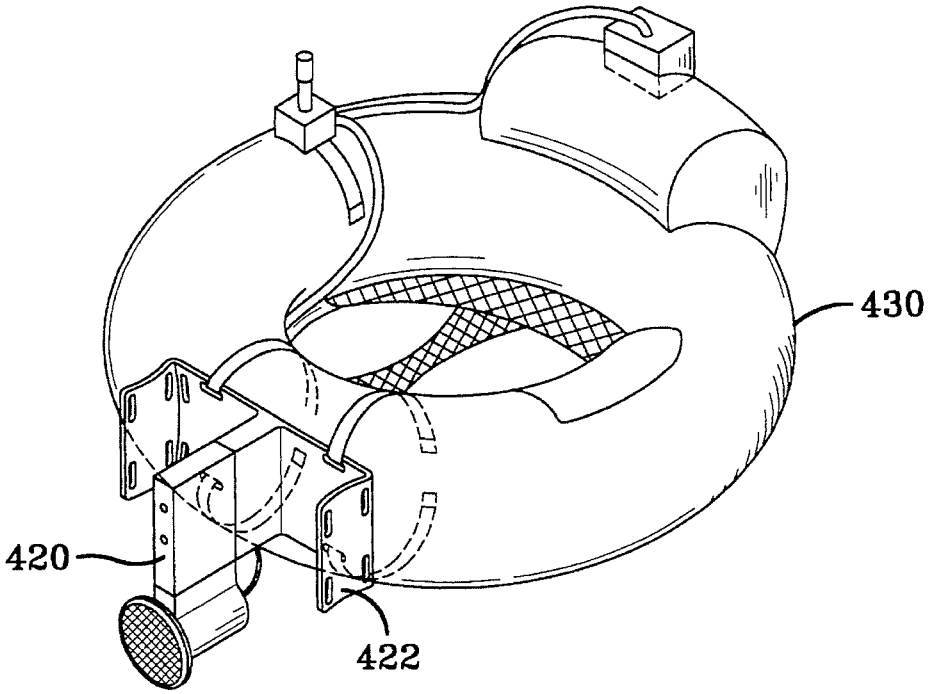
FIG. 13 is a view in perspective illustrating an adaptor block in its operable position.
Figure 14:
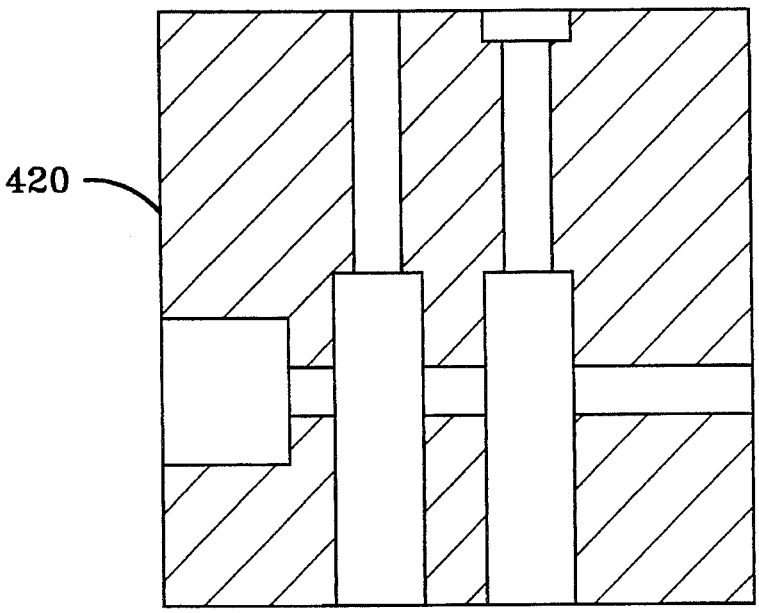
FIG. 14 is a side view in section illustrating the adaptor block.

An adaptor block 420 is shown attached to propulsion apparatus 422 in FIG. 13. Adaptor 420 is shown in section in FIG. 14, revealing the passages formed through the rectangular, block-shaped device. The passages formed through adaptor 420 are for passing fasteners, such as bolts, to permit attachment of the adaptor 420 to the propulsion apparatus 422, and also attachment of a motor housing to the adaptor 420 in one of two positions shown in FIGS. 15 and 16.

Figure 15:
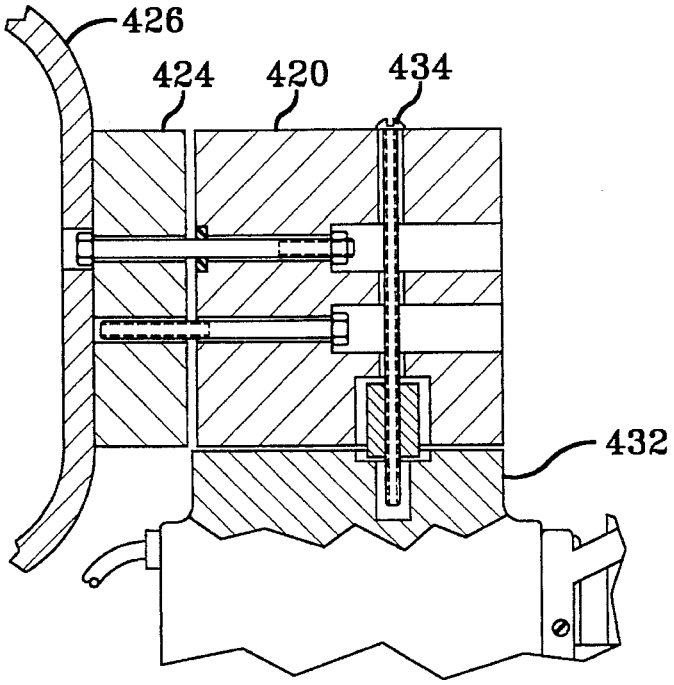
FIG. 15 is a side view in section illustrating the adaptor block in an operable position.

FIG. 15 shows adaptor block 420 in its operable position as illustrated in FIG. 13. Adaptor 420 attaches at one of its sides to motor housing column 424 which is attached to a central panel 426. Central panel 426 is shown attached to float tube 430 in FIG. 13. Motor housing 432 is attached to the underside of adaptor 420 by bolt 434 which pivotably mounts motor housing 432 to adaptor 420. A steering device, such as an L-shaped rod, can be attached to bolt 434 as an alternative steering means.

The adaptor 420, in the position shown in FIG. 15, extends motor housing 432 a greater distance away from the float tube 430 and changes the orientation of the motor housing 432 with respect to central panel 426. This change in orientation permits the central panel 426 to be mounted to the side, rather than the underside, of float tube 430, since the new orientation of motor housing 432 directs the thrust of the motor in a direction which is angled 90° from the central panel 426 as in the preferred embodiment shown in FIG. 4. This new orientation permits the propulsion apparatus 422 to be attached to the front of a float tube 430 and positions the motor propeller substantially farther away from the fisherman using the float tube 430 than without the adaptor 420.

Figure 16:
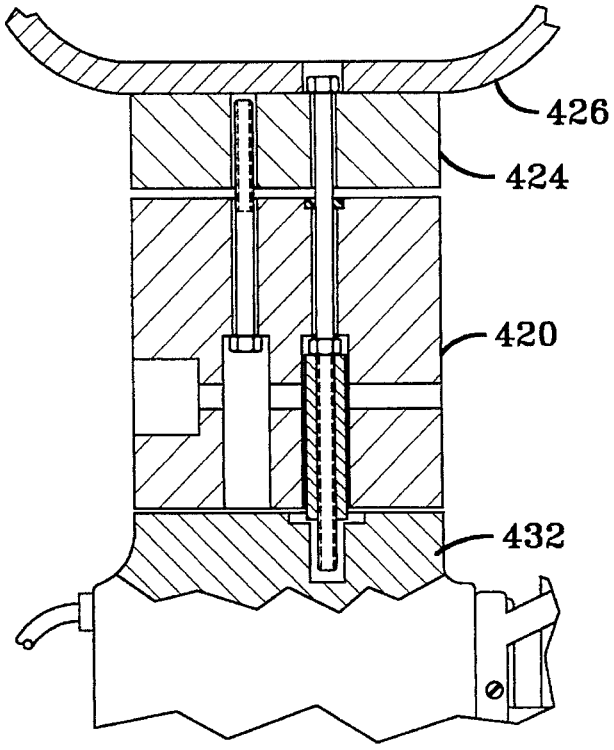
FIG. 16 is a side view in section illustrating the adaptor block in an operable position.

In FIG. 16, adaptor 420 is shown similarly attached to motor housing column 424 as in FIG. 15. However, motor housing 432 is attached to a different side of adaptor 420, providing a longitudinal alignment of housing column 424, adaptor 420 and motor housing 432. Mounting panel 426 of FIG. 16 will, in this configuration, be attached to the underside of a float tube or to secondary panels and suspended between parallel pontoons as in FIG. 6, rather than a side. Adaptor 420 acts, in the FIG. 16 configuration, as a spacer to position motor housing 432 farther from mounting panel 426, while leaving the motor thrust directed similarly, with respect to the mounting panel 426, to the preferred embodiment. Adaptor 420 is used in this manner to adjust the depth of motor housing 432, specifically in the case of mounting secondary panels to spaced, parallel pontoons as in FIG. 6.

Figure 10:
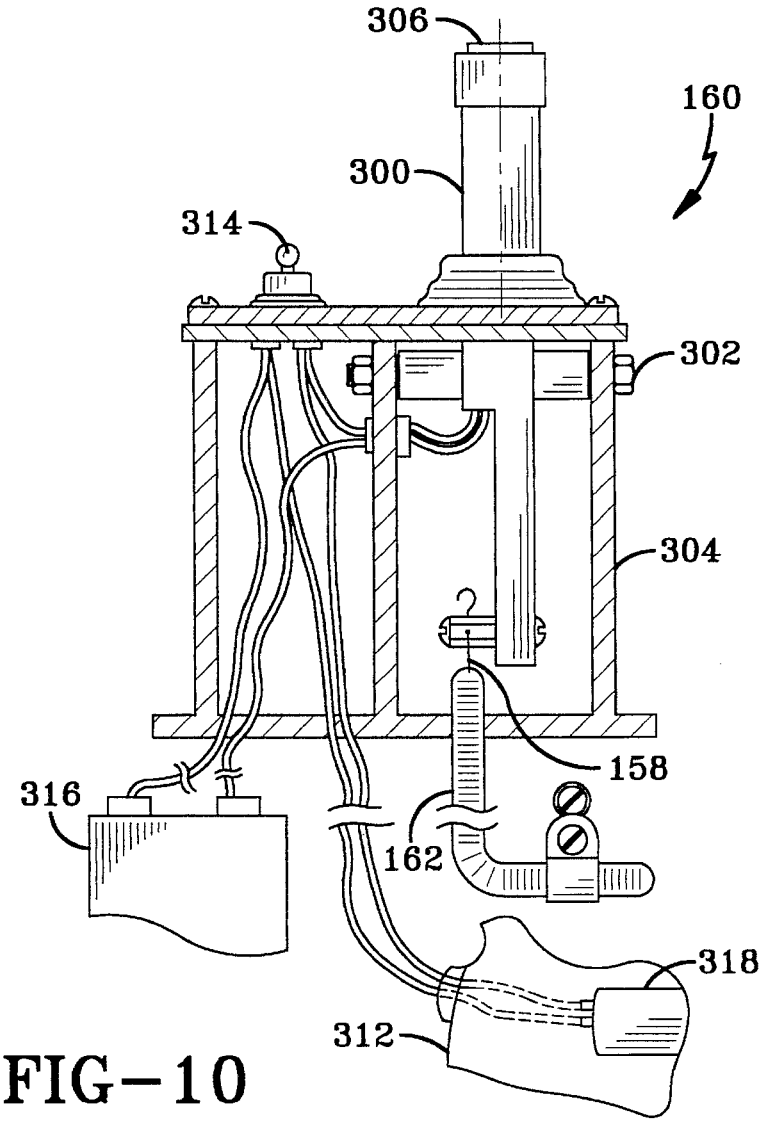
FIG. 10 is a diagrammatic view in section illustrating the preferred element of the invention.

Actuator 160, shown in detail in FIG. 10, includes a lever 300 pivotably mounted at a bolt 302 to a control panel 304. The rear of the control panel 304 is cut away showing the pivot axis bolt 302 and the underside of the lever 300. Cable 158 extends through cable sheath 162 and attaches to motor housing 312 described above with respect to the apparatus of FIG. 7. Pivoting of the lever 300 in one direction withdraws cable 158 from the sheath 162, rotating motor housing 312 to one side. Tilting of the lever 300 in the opposite direction extends cable 158, thereby rotating housing 312 to the opposite side.

The actuator 160 could be replaced by a hydraulic device which actuates the pivotal motion of the motor housing 156 with respect to the mounting panel 152. Any of numerous conventional actuators could substitute for the preferred actuator 160, so long as it is capable of actuating the motor housing 156 in pivotal rotation about the shaft 150.

Figure 9:
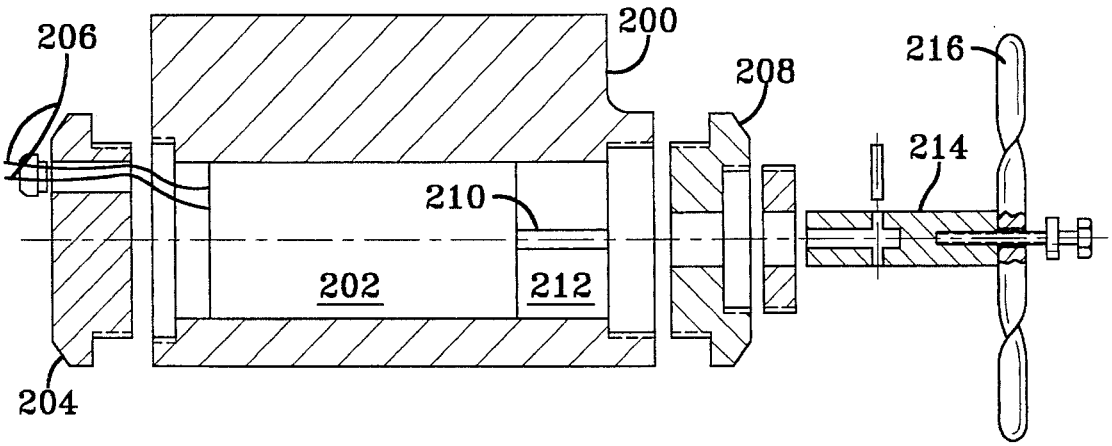
FIG. 9 is a side view in section illustrating a preferred motor housing.

FIG. 9 shows the preferred motor housing 200, which is made of welded polyvinyl chloride (PVC) but could be molded, and motor 202 positioned therein. Motor 202 is preferably a gear motor having 85 inch-ounces of power and weighs about 1 pound as is sold under the trademark PITTMAN model GM9234C420. Motor 202 could also be a 14 inch-ounce power direct shaft motor as is sold under the trademark ITT AUTOMOTIVE model 403207. A rear cap 204 seals the terminal end of the motor housing 200 and has motor terminal wires 206 extending therethrough. Front cap 208 seals the housing 200 at the opposite end and has motor shaft 210 passing therethrough. End caps 204 and 208 preferably threadingly attach to housing 200 but could use O-rings around the cap periphery and screws tapped through the caps and into housing 200, thereby sealing the motor 202 in an air-tight and water-tight chamber 212. Propeller shaft 214, which is made of plastic such as that sold under the trademark DELRON, sold by Dayton Plastics, attaches to propeller 216 at one end and attaches to motor shaft 210 at its opposite end in a conventional manner. Shaft 214 could also be stainless steel. Propeller 216 is a model airplane propeller sold under the trademark MASTER AIRSCREW, and the model used varies according to speed and power desired. The preferred propeller for streams has a pitch of 8 degrees and a length of 13 inches, with 2 inches cut off each end for a final length of 9 inches. For a large body of water where less power is needed, a 7 and one-half degree pitch propeller of 10 inch length having 1½ inches cut off of each end for a 7 inch final length is preferred. The motor 202 is preferably removable from the housing 200 for replacement or repair.

Referring to FIG. 10, switch 314 directs the current from battery 316 through motor 318. Switch 314 is a conventional double pole, double throw switch which reverses the polarity of the connections between the battery 316 and the motor 318. The battery 316 is preferably a lead-acid, 12 volt 5 amp-hour battery sold under the trademark CAREFREE, which weighs less than 4 pounds. Switch 314 reverses the direction of rotation of motor 318 and therefore an attached propeller. Button 306 is an on–off switch for motor 318. When button 306 is depressed, current from battery 316 flows through motor 318 with the polarity determined by switch 314.

Figure 11:
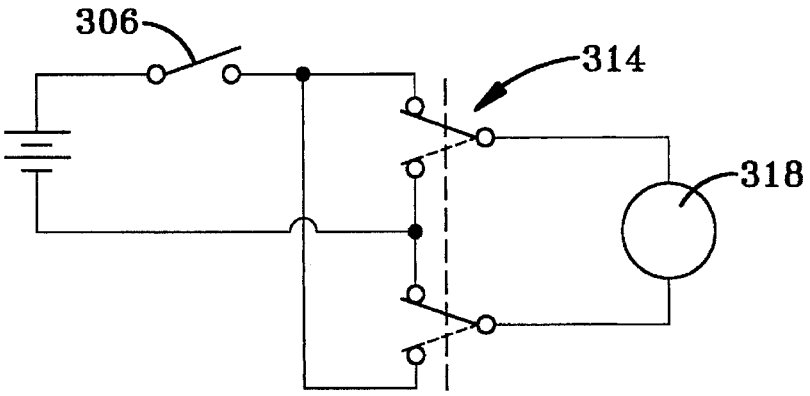
FIG. 11 is a circuit diagram of the preferred embodiment.

FIG. 11 shows a circuit diagram illustrating the electronic circuitry of FIG. 10 including motor 318, button 306 and switch 314, represented by electronic symbols.

Referring again to FIG. 7, a protective housing 180 surrounds propeller 182 to prevent an angler's clothing and fishing equipment (or any other foreign object other than the water) from contact with the propeller 182. Protective cover 180 preferably is made of lightweight metal or plastic and screws onto motor housing 156 by screws 184.

While certain preferred embodiments of the present invention have been disclosed in detail, it is to be understood that various modifications may be adopted without departing from the spirit of the invention or scope of the following claims.

I claim:

1. A propulsion apparatus for attachment to a float tube having an outer skin extending around and conforming to a cylindrical portion of the float tube forming a curved outer surface, the apparatus comprising:

(a) a mount including a first mounting panel having a concave face conformed to seat against the curved outer surface of the float tube and a second mounting panel having a concave face conformed to seat against the curved outer surface of the float tube wherein the mounting panels are adjustably mounted to a central mount member for adjustably spacing the concave, mounting panel faces;

(b) a first fastener, at least a portion of which is conformed to attach to the outer skin of the float tube for removably fastening the first mounting panel to the outer skin;

(c) a second fastener, at least a portion of which is conformed to attach to the outer skin for removably fastening the second mounting panel to the outer skin;

(d) a motor housing pivotally connected to the mount and housing a motor to which a propeller is attached; and (e) an energy source providing energy to the motor.

2. An apparatus in accordance with claim 1, wherein the concave faces of the mounting panels face substantially opposite to one other, and are conformed to seat against two spaced outer surfaces of the float tube.

3. An apparatus in accordance with claim 1, wherein each fastener comprises a backing member positioned against an interior face of the outer skin, and a bracket member positioned against an opposite, exterior face of the outer skin, for clamping the outer skin between the members.

4. An apparatus in accordance with claim 1, wherein the motor housing is pivotally mounted to the central member by a shaft extending downwardly from the central member into the motor housing.

5. An apparatus in accordance with claim 4, further comprising an actuator connected to the motor housing and the central member for pivoting the motor housing relative to the central member.

6. An apparatus in accordance with claim 5, further comprising a flexible cable mounted to the motor housing at a first end and connected to the actuator at a second, opposite end, and a cable sheath rigidly mounted to the central member.

7. An apparatus in accordance with claim 1, further comprising a controller for controlling the speed and direction of rotation of the motor.

8. An apparatus in accordance with claim 1, wherein an adaptor is mounted between the motor housing and the mounting panel, said adaptor mounting rigidly to the mounting panel and pivotably to the motor housing.

9. A motorized float tube in accordance with claim 1, wherein at least one mounting panel seats against an underside surface of the float tube for submerging the mounting panel, motor and motor housing beneath water.

10. A propulsion apparatus for attachment to a float tube having an outer skin extending around and conforming to a cylindrical portion of the float tube forming a curved outer surface, said outer skin having a seam formed between adjoining edges, the apparatus comprising:

(a) a mount including first and second mounting panels, each panel having a concave face conformed to seat against the curved outer surface of the float tube;

(b) a motor housing pivotally connected to the mount and housing a motor to which a propeller is attached;

(c) first and second fasteners attached to the outer skin on opposite sides of the seam, each fastener comprising a backing member positioned against an interior face of the outer skin, and a bracket member positioned against an opposite, exterior face of the outer skin, for clamping the outer skin between the members;

(d) first and second flexible belts, each belt being attached to a respective one of the mounting panels extending circumferentially around the cylindrical portion of the float tube and fastened to one of the first and second fasteners; and (e) an energy source providing energy to the motor.

11. An apparatus in accordance with claim 10, wherein:

(a) the first belt extends away from the mounting panel around the cylindrical portion of the float tube in one direction, past the seam, to the first fastener; and (b) the second belt extends away from the mounting panel around the cylindrical portion of the float tube in the direction opposite the first belt, past the seam, to the second fastener.

12. A fastener apparatus fastening a float tube accessory to a float tube, the float tube having an outer skin extending around and conforming to a cylindrical portion of the float tube forming a curved outer surface, said outer skin having a seam formed between adjoining edges, the fastener apparatus comprising:

(a) first and second backing members positioned against interior faces of the outer skin;

(b) first and second bracket members positioned against exterior faces of the outer skin, clamping the outer skin between the members, attaching the members to the outer skin on opposite sides of the seam; and (c) first and second belts affixed to a float tube accessory, extending circumferentially around the cylindrical portion of the float tube and fastening to the first and second bracket members.

13. An apparatus in accordance with claim 12, wherein:

(a) the first belt extends away from the float tube accessory around the cylindrical portion of the float tube in one direction, past the seam, to the first bracket member; and (b) the second belt extends away from the float tube accessory around the cylindrical portion of the float tube in the direction opposite the first belt, past the seam, to the second bracket member.

14. A motorized float tube, comprising:

(a) an outer skin extending around and conforming to a cylindrical portion of the float tube, forming a curved outer surface;

(b) a first mounting panel having a concave face seating against the curved outer surface of the float tube;

(c) second and third mounting panels attached to opposite ends of the first mounting panel, the second and third mounting panels having substantially oppositely directed concave faces;

(d) a fastener, removably attached to the first mounting panel, affixed to the outer skin of the float tube, removably fastening the first mounting panel to the outer skin;

(e) a motor housing pivotally connected to the first mounting panel and housing a motor to which a propeller is attached; and (f) an energy source providing energy to the motor.

15. A motorized float tube in accordance with claim 14, wherein the mounting panel seats against an underside surface of the float tube for submerging the mounting panel, motor and motor housing beneath water.

* * * * *

UNITED STATES PATENT AND TRADEMARK OFFICE

CERTIFICATE OF CORRECTION

PATENT NO. : 5,601,461

DATED : Feb. 11, 1997

INVENTOR(S) : Mills

It is certified that error appears in the above-indentified patent and that said Letters Patent is hereby corrected as shown below:

Column 6, line 2, "52" should be --452--.

Signed and Sealed this

Sixth Day of May, 1997

*Attest:*

*Attesting Officer*

BRUCE LEHMAN

*Commissioner of Patents and Trademarks*